US007954294B2

(12) United States Patent
Appleford

(10) Patent No.: US 7,954,294 B2
(45) Date of Patent: Jun. 7, 2011

(54) BUILDING PANEL

(75) Inventor: David Eric Appleford, Ongar (GB)

(73) Assignee: Acermetric Limited, Surrey (GB)

( * ) Notice: Subject to any disclaimer, the term of this patent is extended or adjusted under 35 U.S.C. 154(b) by 274 days.

(21) Appl. No.: 12/159,664

(22) PCT Filed: Jan. 4, 2007

(86) PCT No.: PCT/GB2007/000017

§ 371 (c)(1),
(2), (4) Date: Jul. 28, 2008

(87) PCT Pub. No.: WO2007/077448

PCT Pub. Date: Jul. 12, 2007

(65) Prior Publication Data

US 2008/0302027 A1 Dec. 11, 2008

(30) Foreign Application Priority Data

Jan. 4, 2006 (GB) ..... 0600090.5

(51) Int. Cl.
*E01C 9/08* (2006.01)

(52) U.S. Cl. ..... 52/582.2; 52/127.9

(58) Field of Classification Search ..... 52/127.7, 52/127.9, 127.11, 282.2, 582.2, 591.2
See application file for complete search history.

(56) References Cited

U.S. PATENT DOCUMENTS

| | | | | | |
|---|---|---|---|---|---|
| 102,086 | A | * | 4/1870 | Brown | 126/106 |
| 2,635,450 | A | | 4/1953 | Orzel | |
| 2,647,287 | A | * | 8/1953 | Jones | 52/582.2 |
| 2,714,751 | A | * | 8/1955 | Stuart et al. | 52/582.2 |
| 2,746,098 | A | * | 5/1956 | Cooper et al. | 52/582.2 |
| 2,842,814 | A | * | 7/1958 | Lindgren | 160/113 |
| 3,280,522 | A | | 10/1966 | Palfey et al. | |
| 3,327,447 | A | * | 6/1967 | Nissley | 52/582.2 |
| 3,353,314 | A | | 11/1967 | Melcher | |
| 3,392,497 | A | * | 7/1968 | Cushman | 52/272 |
| 3,496,692 | A | * | 2/1970 | Melcher | 52/583.1 |
| 3,565,469 | A | * | 2/1971 | Zwart | 52/582.2 |
| 3,661,410 | A | * | 5/1972 | Larson et al. | 52/127.9 |
| 3,671,006 | A | * | 6/1972 | Berkowitz | 249/97 |
| 3,712,653 | A | * | 1/1973 | Lehmann | 52/582.2 |

(Continued)

FOREIGN PATENT DOCUMENTS

WO 2004 074593 9/2004

*Primary Examiner* — Brian E Glessner

*Assistant Examiner* — Beth Stephan

(74) *Attorney, Agent, or Firm* — Summa, Addition & Ashe, P.A.

(57) ABSTRACT

A building panel (1) has a major plane and is configured to interengage with at least one other adjacent like panel. The panel (1) has two major side surfaces (16) which are parallel to the major plane, and four major edge surfaces (2, 3) forming a perimeter (4) of the panel (1). An over-center camlock mechanism (7) is retractably extendable from each major edge surface (2, 3). Each major edge surface (2, 3) has a recess with an associated recess (17) at each major side surface (16), so that each recess is adjacent to at least one other recess. There is a pin in each recess and any over-center camlock mechanism (7) is latchingly engageable with the pin in any one of the recesses of the adjacent like panel so that the major planes of the two panels, when interengaged, are selectively parallel and coincident or perpendicular.

14 Claims, 9 Drawing Sheets

U.S. PATENT DOCUMENTS 3,729,889 A * 5/1973 Baruzzini ..... 52/264
3,785,103 A * 1/1974 Turner ..... 52/309.11
4,020,613 A * 5/1977 Reynolds et al. ..... 403/321
4,223,500 A * 9/1980 Clark et al. ..... 52/309.4
4,402,167 A * 9/1983 Denucci ..... 52/426
4,417,430 A * 11/1983 Loikitz ..... 52/582.2
4,507,010 A * 3/1985 Fujiya ..... 403/322.1
4,512,122 A * 4/1985 Berkowitz ..... 52/127.9
4,574,537 A * 3/1986 Krieger ..... 52/127.9
4,625,477 A * 12/1986 Johnstonbaugh ..... 52/127.9
4,930,753 A 6/1990 Alvyn
5,038,535 A * 8/1991 Van Praag, III ..... 52/127.9
5,134,826 A * 8/1992 La Roche et al. ..... 52/584.1
5,212,924 A * 5/1993 Finkelstein ..... 52/582.2
5,323,564 A * 6/1994 Mensching et al. ..... 52/7
5,806,273 A * 9/1998 Kaminski et al. ..... 52/586.1
6,119,427 A * 9/2000 Wyman et al. ..... 52/584.1
6,692,808 B2 * 2/2004 Bristow ..... 428/61
6,892,498 B1 * 5/2005 Roman ..... 52/79.5
7,162,838 B2 * 1/2007 Ardern ..... 52/127.9
2005/0223665 A1 10/2005 Maas

* cited by examiner

BUILDING PANEL

BACKGROUND OF THE INVENTION

The present invention relates to a building panel and, more particularly, to a building panel which may be assembled in an interengaging manner with at least one other adjacent like building panel.

WO 2004/074593 discloses quadrilateral building panels which have at least two degree rotational symmetry when rotated about a central axis extending perpendicularly to a plane containing a major surface of the panel. A structure can be built using a plurality of these panels assembled in an interengaging manner and adjacent panels may be secured to each other by locking cams. However, the document does not disclose how locking cams could secure adjacent building panels to each other so that their major planes are either substantially parallel and coincident or substantially perpendicular.

SUMMARY OF THE INVENTION

An object of the present invention is to provide a building panel which is arranged to interengage with at least one other adjacent like panel that solves this problem.

To this end, the invention consists in a building panel having a major plane and being configured to interengage with at least one other adjacent like panel, the panel having:

two major side surfaces which are at least substantially parallel to the major plane, and at least three major edge surfaces substantially forming a perimeter of the panel;

an engaging means first portion at one said major edge surface;

an engaging means second portion comprising three parts situated respectively at the two major side surfaces and at one said major edge surface, each said part being adjacent to at least one other said part; and at least one of said engaging means first portion and said engaging means second portion part is situated at each said major edge surface whereby the engaging means first portion is latchingly engagable with any one of the engaging means second portion parts of said adjacent like panel so that the major planes of the two panels, when interengaged, are selectively substantially parallel and coincident or substantially perpendicular.

Each said part of the engaging means second portion may comprise at least one recess in said major edge surface or said major side surface. The engaging means second portion may have a pin in each said recess.

The engaging means first portion may be arranged to extend from said major edge surface. The engaging means first portion may be retractably extendable from said major edge surface.

At least one said major edge surface may have said engaging means first portion and one said part of said engaging means second portion. At least one said major edge surface may include at least one inwardly stepped portion and at least one outwardly stepped portion and each inwardly stepped portion is dimensioned to receive an outwardly stepped portion on an edge surface of an adjacent panel.

The engaging means first portion preferably comprises an over-centre camlock mechanism for latchingly engaging the pin.

The building panel may have at least two degree rotational symmetry when rotated about a central axis extending perpendicularly to said major plane.

A structure may be formed which comprises a plurality of said building panels as described above and assembled in an interengaging manner.

A structure may be formed which includes at least one said building panel as described above, and at least one panel comprising at least part of a column or beam, said column or beam panel having engaging means first and/or second portions for latchingly engaging any one of the engaging means second portion parts and/or the engaging means first portion of said building panel. The columns and beams having said engaging means first and/or second portions can be utilized to provide additional strength for taller (e.g. multi-storey) buildings and larger spans than would be possible using the building panels alone.

The structure may include three said building panels, the first panel of said three panels having said engaging means second portion, the second panel of said three panels having said engaging means first portion engaging one said part of the engaging means second portion of said first panel, and the third panel of said three panels having said engaging means first portion engaging another one of said parts of the engaging means second portion of said first panel, wherein the major planes of said three panels form a "T".

The structure may include a fourth said building panel, said fourth panel engaging another one of said parts of the engaging means second portion of said first panel, wherein the major planes of said four panels form a cross.

In a preferred embodiment, one major side surface of the building panel has access means for providing access for a tool to operate the engaging means first portion. The access means may only be accessible from inside the structure ensuring that the structure is secure. Nevertheless, the structure can be dismantled or modified at any time. Alternatively, both major side surfaces of the building panel may have access means for providing access for a tool to operate the engaging means first portion.

BRIEF DESCRIPTION OF THE DRAWINGS

Embodiments of the present invention will now be described, by way of example, with reference to the accompanying drawings, in which:—

DETAILED DESCRIPTION OF THE INVENTION

Figure 1:
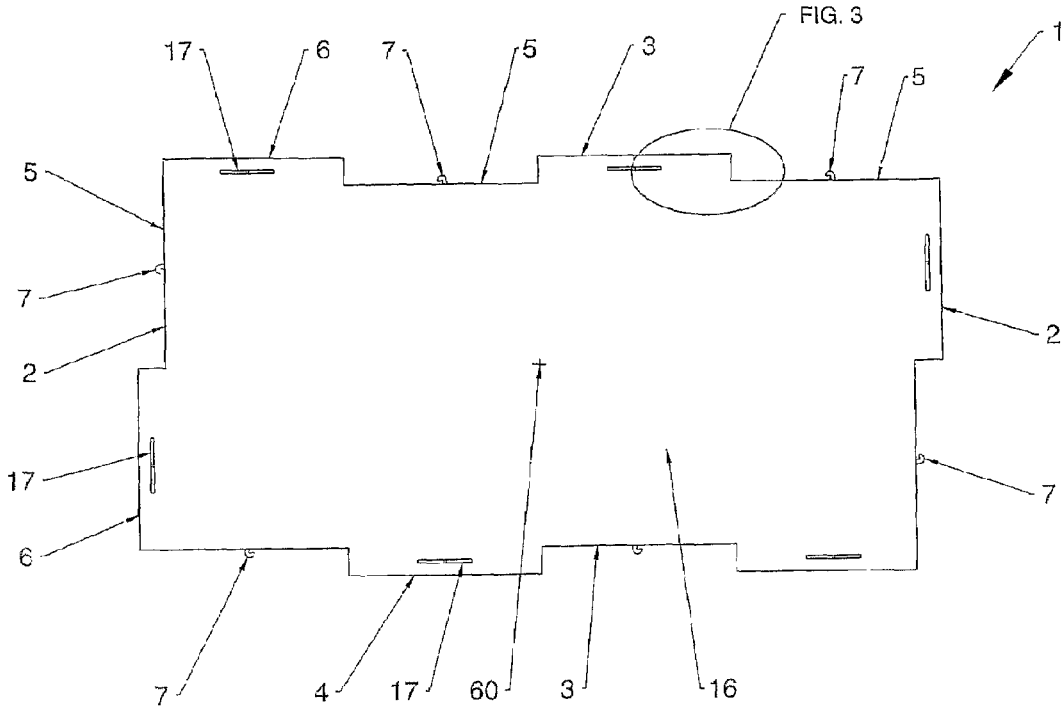
FIG. 1 is a plan view of a building panel constructed in accordance with one embodiment of the invention.

Referring to FIG. 1 of the accompanying drawings, the building panel 1 is generally rectangular in plan and has opposed major end edge surfaces 2 interconnected by opposed major side edge surfaces 3 defining a surrounding perimeter edge 4 made up from alternating relatively inwardly stepped portions 5 and relatively outwardly stepped portions 6. The panel 1 includes one inwardly stepped portion 5 and one outwardly stepped portion 6 or lug along each major end edge surface 2 and two inwardly stepped portions 5 and two outwardly stepped portions 6 or lugs along each major side edge surface 3. The length of each inwardly stepped portion 5 is dimensioned to receive a complementary outwardly stepped portion 6 of an adjacent like panel 1 which is coplaner or orthogonal and the stepped portions 5,6 are arranged so that the panel 1 has two degree rotational symmetry when rotated about a central axis 60 extending perpendicularly to a major side surface 16 of the panel 1.

Figure 2:
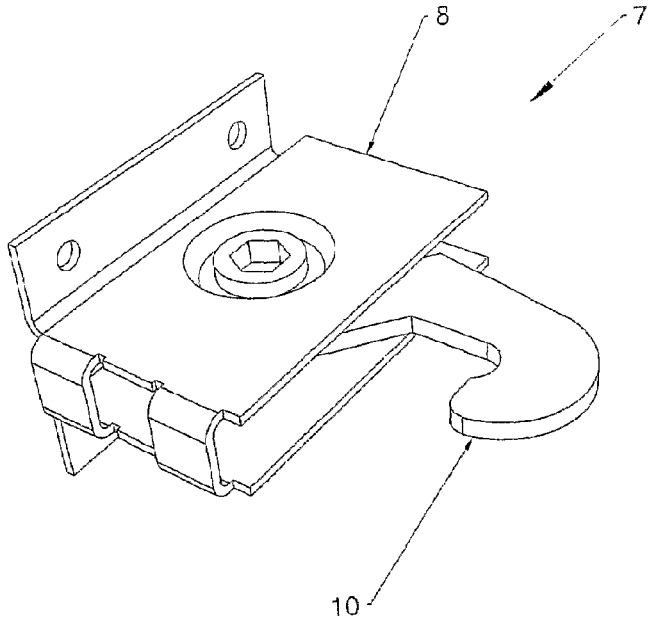
FIG. 2 is a perspective view of a hook and cam mechanism for the building panel.
Figure 4:
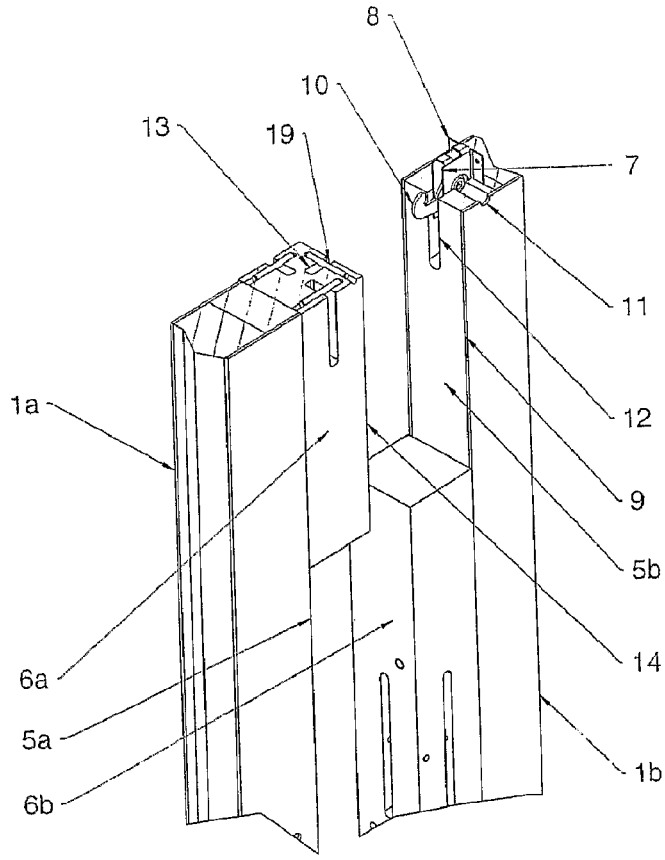
FIGS. 4 to 6 are perspective views of two building panels being interengaged so as to be parallel, coplanar and adjoining.

Each inwardly stepped portion 5 has a hook and cam mechanism or an over-centre camlock mechanism 7 which is shown in FIG. 2. Referring to FIG. 4, the mechanism 7 has a mounting 8 mounted beneath the edge surface 9 of the inwardly stepped portion 5. The hook 10 or latch of the mechanism 7 is rotatably mounted in the mounting 8 and the axis of rotation is midway along the length of the inwardly stepped portion 5. One side of the panel 1 has a hole 11 to provide access for a suitable tool, such as an Allen key, to rotate the hook 10 about the mounting 8 so that it protrudes from a slot 12 or recess in the edge surface 9. Final travel of the tool operates an over-centre cam (not shown) within the camlock mechanism 7 to lock the hook 10. The slot 12 is of a sufficient length in order to fully contain the hook 10 when the hook 10 is rotated by the tool so as to be unlocked and fully retracted before being locked in an open position ensuring that personnel and other panels cannot be damaged by protruding hooks. A suitable hook and cam mechanism or over-centre camlock mechanism 7 is described in U.S. Pat. No. 6,409,235.

Figure 3:
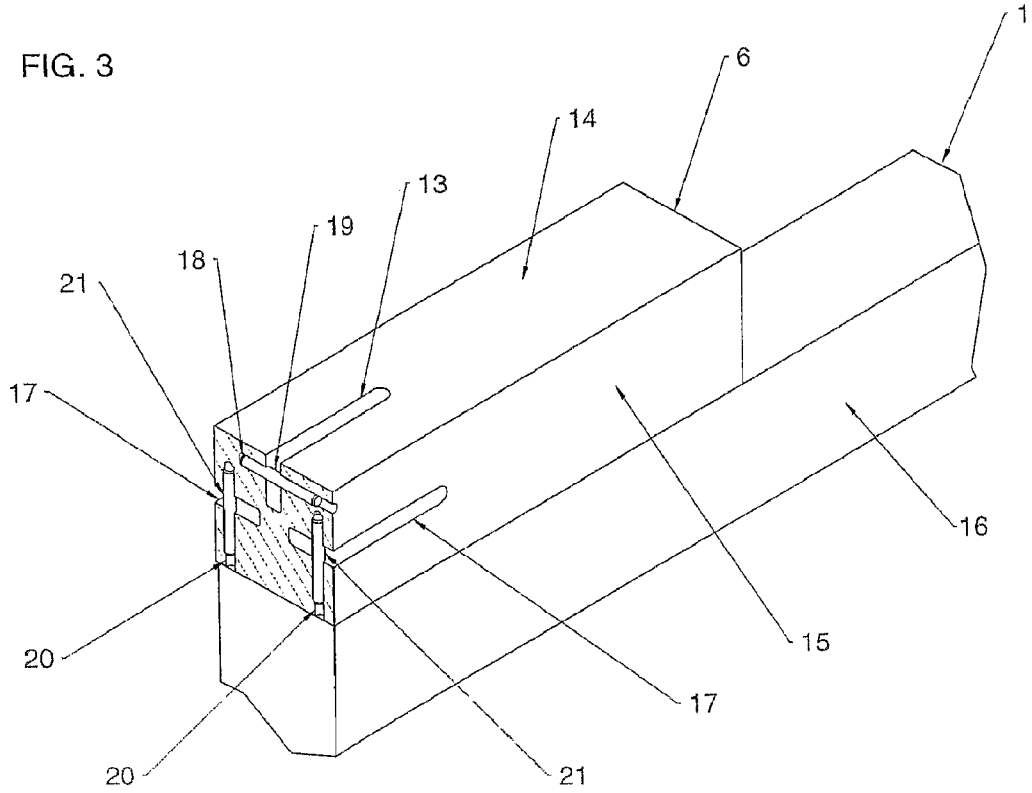
FIG. 3 is a perspective sectional view through an outwardly stepped portion of the building panel.

Referring to FIG. 3, each outwardly stepped portion 6 has a slot 13 or recess extending longitudinally along its edge surface 14. Each portion 15 of the two major side surfaces 16 of the building panel 1 which form the sides of each outwardly stepped portion 6 also has a longitudinally extending slot 17 or recess. The slots 13,17 are all located midway along the length of the outwardly stepped portion 6. A hole 18 extends from one side portion surface 15 into the outwardly stepped portion 6 and a pin 19 is inserted into the hole 18 and crosses the slot 13 beneath the edge surface 14. The bottom of the outwardly stepped portion 6 has a pair of holes 20 extending therein and a pin 21 is inserted into each hole 20 which crosses the slot 17 beneath the side portion surfaces 15. The axes of the pins 19,21 are all located along the middle of the outwardly stepped portion 6. The outwardly stepped portion 6 is attached to the main body of the building panel 1 so that the holes 20 in the bottom are sealed. In a preferred embodiment, each pin 19,21 comprises a metal dowel.

Referring to FIGS. 4 to 8, a first building panel 1*a* is shown having a second building panel 1*b* attached so as to be coplanar and adjoining and third and fourth building panels 22*a*, 22*b* attached which are perpendicular to the first and second building panels 1*a*,1*b*. The first and second panels 1*a*,1*b* are the same and the third and fourth panels 22*a*,22*b* are similar to the first and second panels 1*a*,1*b* except that they do not have inwardly and outwardly stepped portions on the edge surface so that they can abut the first and second panels 1*a*,1*b*.

The inwardly stepped portion 5*a* of the first building panel 1*a* is arranged to receive the outwardly stepped portion 6*b* of the second building panel 1*b* and the outwardly stepped portion 6*a* of the first building panel 1*a* is arranged to be received by the inwardly stepped portion 5*b* of the second building panel 1*b* (FIG. 4).

Figure 5:
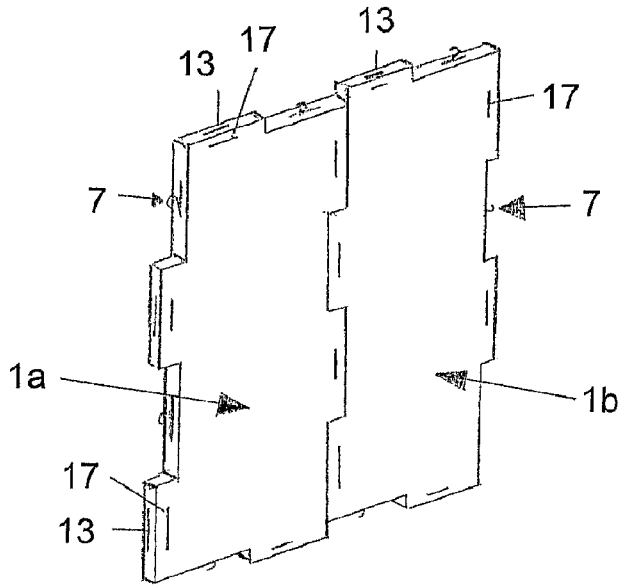
Figure 6:
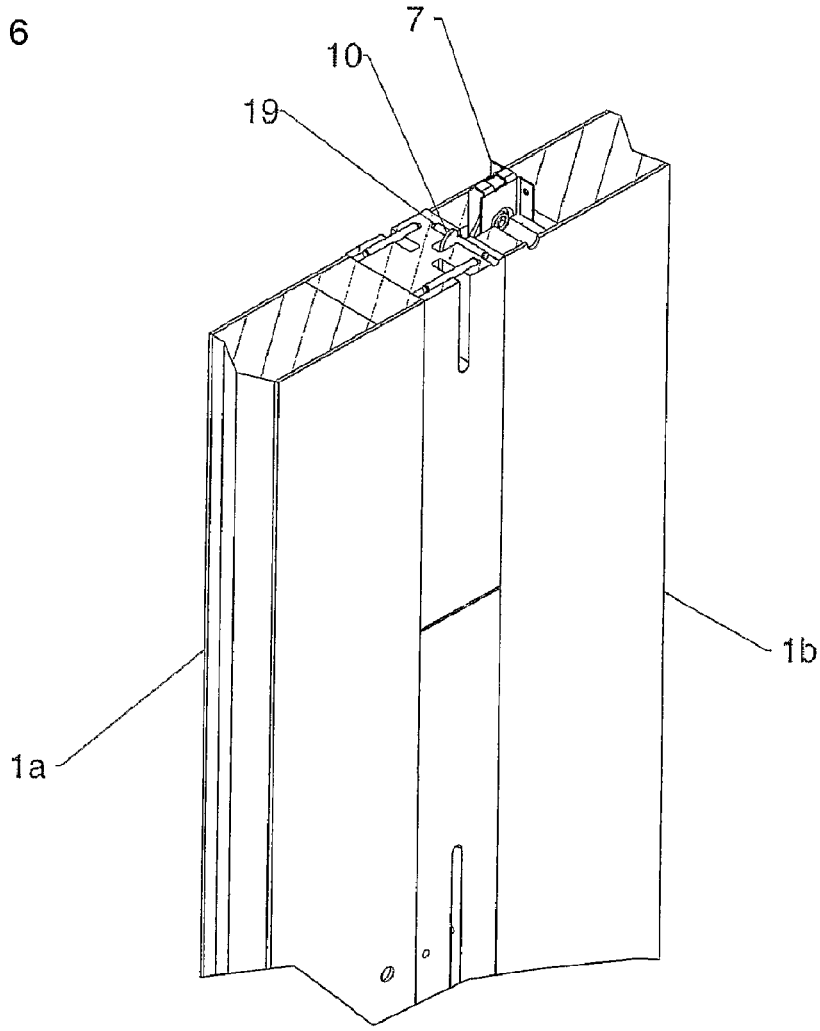

When the two panels 1*a*,1*b* are engaged the hook 10 of the over-centre camlock mechanism 7 of the inwardly stepped portion 5*b* of the second building panel 1*b* is rotated by a tool so that it is received by the slot 13 in the edge surface 14 of the outwardly stepped portion 6*a* of the first building panel 1*a* so that it hooks around the pin 19 therein (FIGS. 5 and 6). Final travel of the tool operates the over-centre cam within the mechanism 7, pulling the two panels 1*a*,1*b* together with significant force ensuring that they cannot come together without application of the tool. In the same way, the hook of the over-centre camlock mechanism (not shown) in the inwardly stepped portion 5*a* of the first building panel 1*a* is rotated so that it hooks around the pin in the outwardly stepped portion 6*b* of the second building panel 1*b*.

Figure 7:
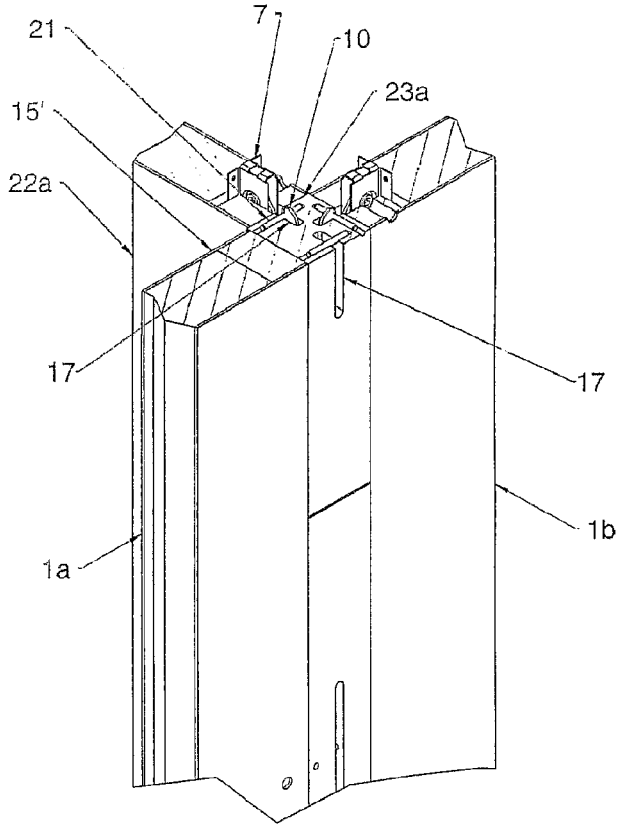
FIGS. 7 and 8 are perspective views of the interengaged panels of FIGS. 5 and 6 having additional panels connected to them.

The third panel 22*a* is then placed perpendicularly against the interengaged first and second panels 1*a*,1*b* and the hooks 10 of the over-centre cam mechanisms 7 of the third panel edge surface 23*a* adjacent the panels 1*a*,1*b* are rotated so that they are received by the corresponding slots 17 in the side portion surface 15' of the outwardly stepped portions 6*a*,6*b* of the first and second panels 1*a*,1*b* and engage the pins 21 therein (FIG. 7). The interengaged panels 1*a*,1*b*,22*a* form a "T".

Figure 8:
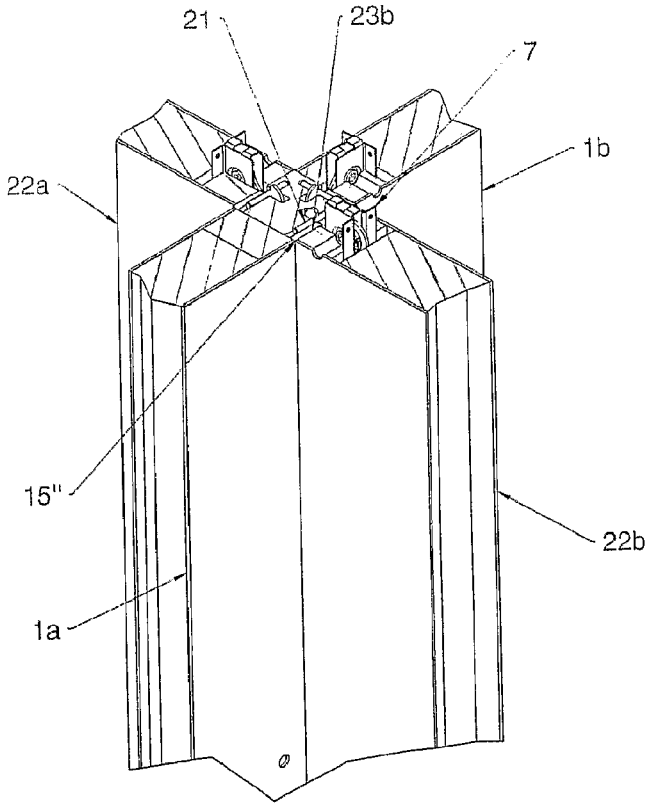

In the same way, the fourth panel 22*b* is placed opposite the third panel 22*a* so that the over-centre camlock mechanisms 7 of the fourth panel 22*b* for the edge surface 23*b* adjacent the panels 1*a*,1*b* are rotated so that they engage the pins 21 in the opposite side portion surface 15" of the outwardly stepped portions 6*a*,6*b* (FIG. 8). The interengaged panels 1*a*,1*b*,22*a*, 22*b* form a cross.

Figure 9:
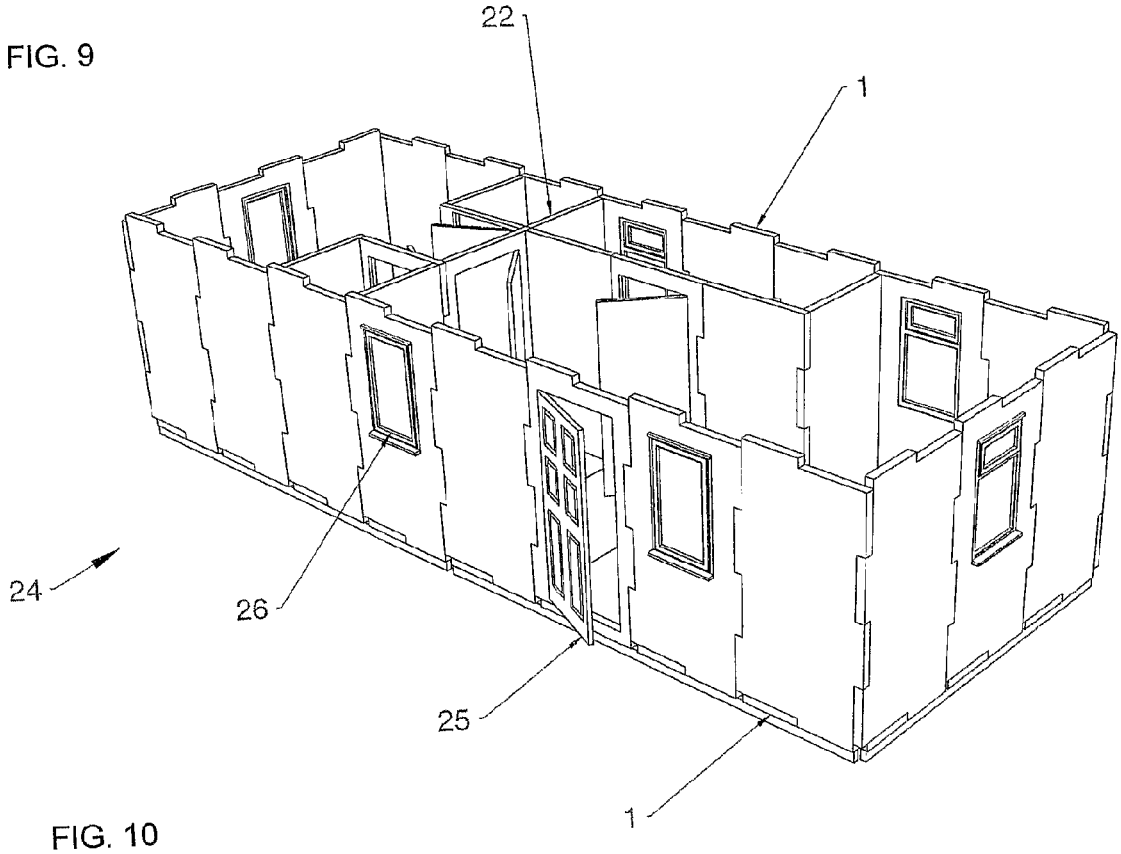
FIG. 9 is a perspective view of a structure constructed with the building panels.

The third and fourth panels 22 can form internal partitions of an interlocked structure 24, such as that illustrated in FIG. 9, made from the first and second panels 1 enabling them to butt up against, and lock into, the structure 24. Some of the building panels of the structure 24 are shown as having an opening which contains a door 25 or window 26.

Figure 10:
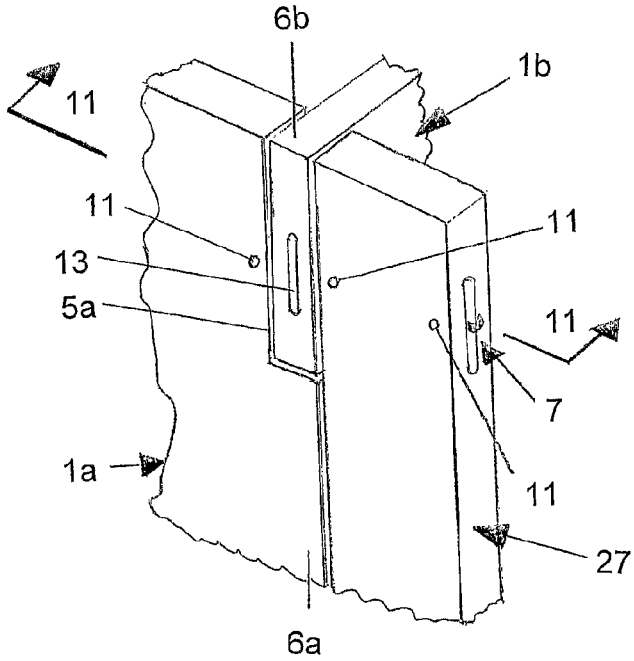
FIG. 10 is a perspective view of a portion of two building panels interengaged so as to be perpendicular with one another and having a column attached thereto.
Figure 11:
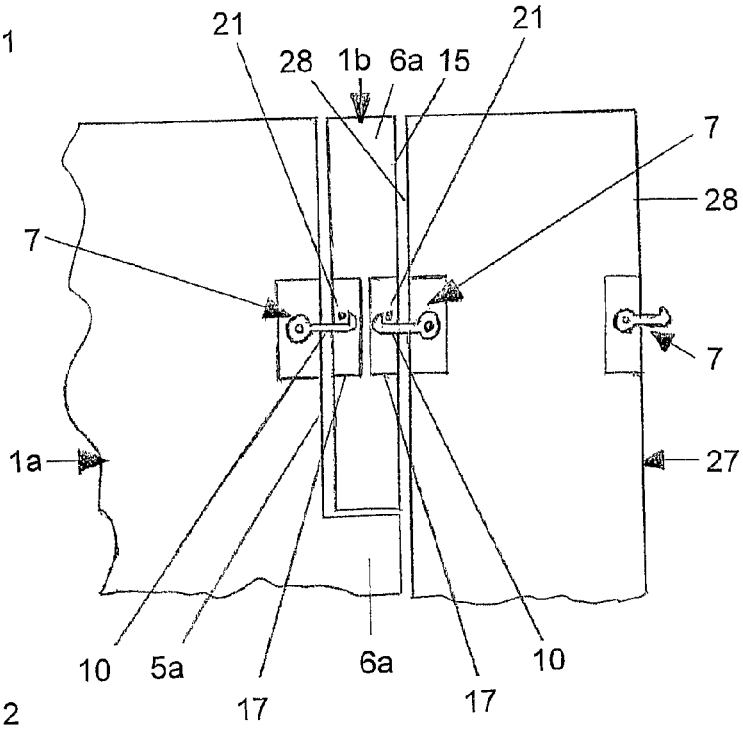
FIG. 11 is a sectional view taken along lines 11-11 shown on FIG. 10.

Referring to FIGS. 10 and 11, two building panels 1*a*, 1*b* are shown interengaged so that their major planes are perpendicular and a column 27 is also attached. The column 27 is similar to the third and fourth building panels 22*a*,22*b* of FIGS. 7 and 8 except that it has pairs of over-centre camlock mechanisms 7 for opposite edge surfaces 28 and both of these surfaces 28 do not have any inwardly and outwardly stepped portions.

The inwardly stepped portion 5*a* of the first building panel 1*a* receives the outwardly stepped portion 6*b* of the perpendicular second building panel 1*b* and the outwardly stepped portion 6*a* of the first building panel 1*a* is received by the inwardly stepped portion of the second building panel 1*b*. The hook 10 of the over-centre camlock mechanism 7 of the inwardly stepped portion 5*a* of the first panel 1*a* engages the pin 21 in the slot 17 of the second building panel side portion surface 15 adjacent the first building panel 1*a*. In the same way, the hook of the over-centre camlock mechanism (not shown) in the inwardly stepped portion of the second building panel 1*b* engages the pin in the slot of the first building panel side portion surface adjacent the second building panel 1*b*. The column 27 is aligned with the first building panel 1*a* so that their major side surfaces are coplaner and adjacent and the hook 10 of the over-centre camlock mechanisms 7 of the column edge surface 28 adjacent the interengaged panels 1*a*,1*b* engages the pins 21 in the slot 17 of the second building panel side portion surface 15 adjacent the column 17 and the pins (not shown) in the slots of the first building panel outwardly stepped portion edge surfaces. Such latching columns 27 can be incorporated into the sides of buildings.

Figure 12:
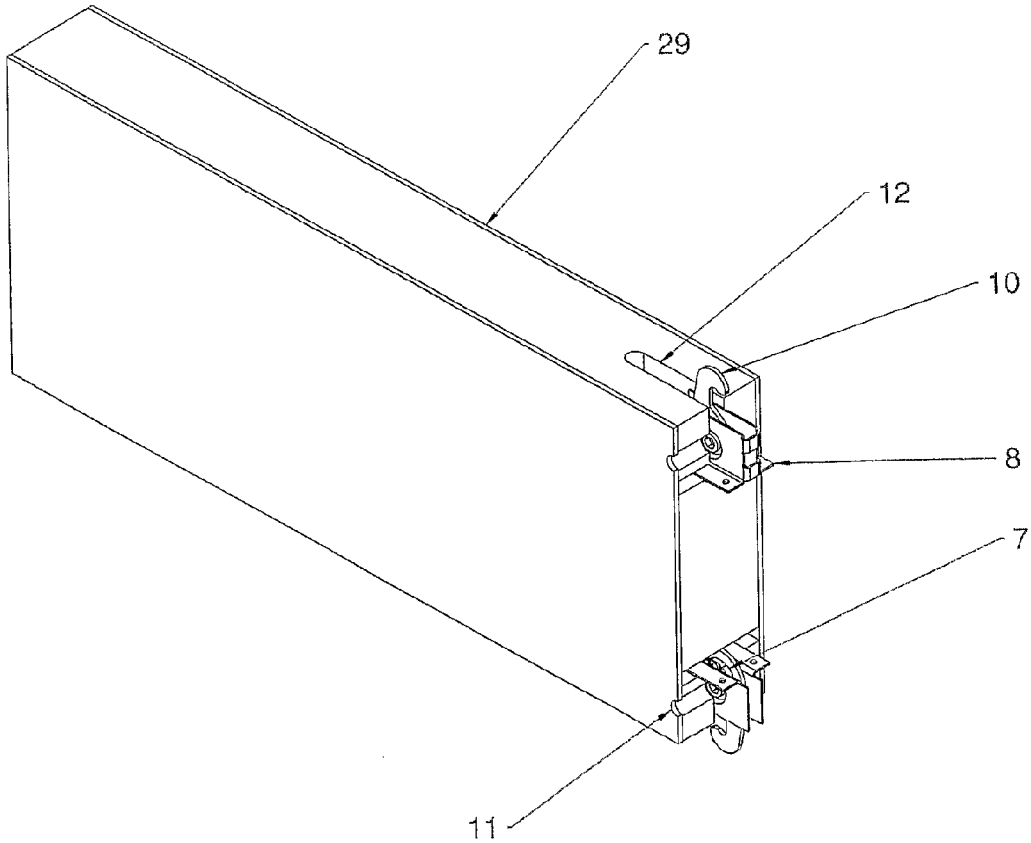
FIG. 12 is a perspective view of part of a beam for connection to a building panel.
Figure 13:
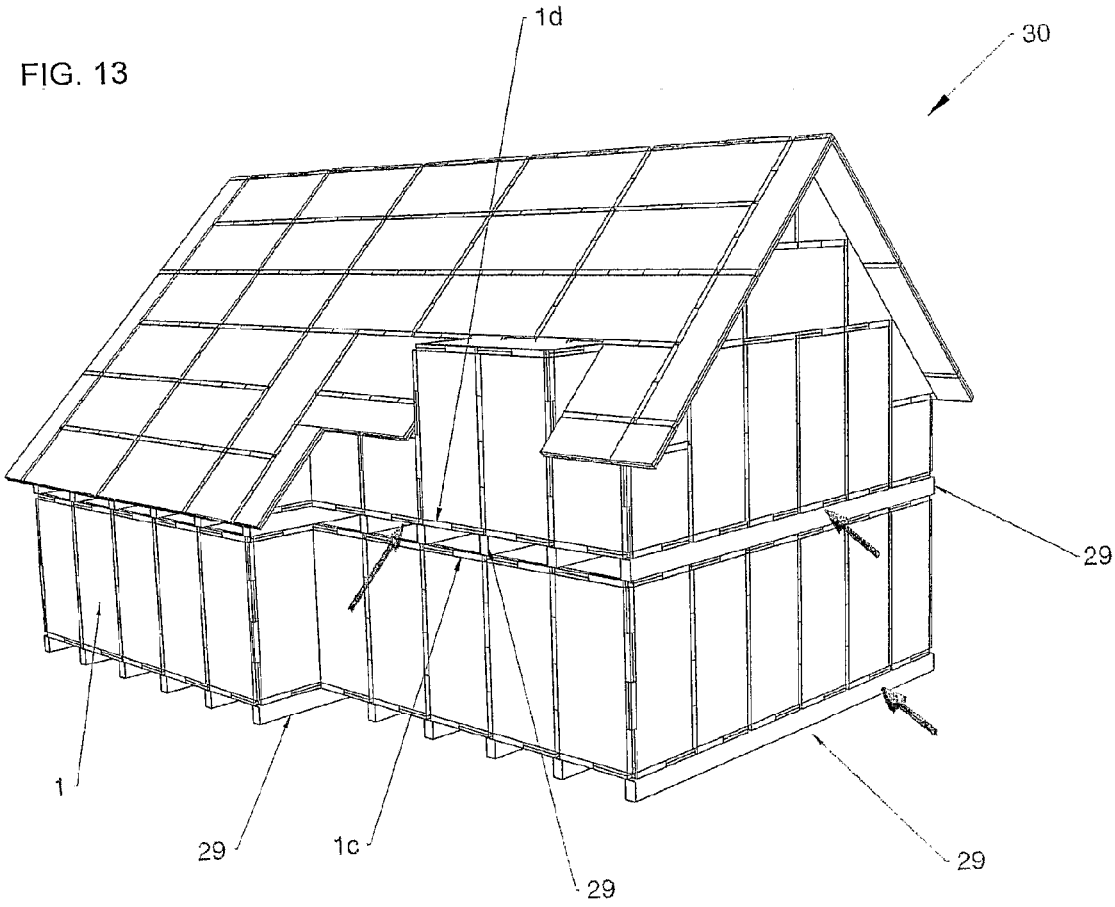
FIG. 13 is a perspective view of a structure incorporating the building panels of FIG. 1 and the beams of FIG. 12.

A beam is illustrated in FIG. 12 which is the same as the column 27 illustrated in FIGS. 10 and 11 except that it is orientated in a different direction. A two storey building 30 using building panels 1 and beams 29 is illustrated in FIG. 13. The beams 29 are parallel to one another, spaced apart at regular panel width distances and lock the ceiling building panels 1*c* of the ground floor to the floor building panels 1*d* of the first floor creating a very strong structure as pseudo-box girders are formed from the ceilings, floors and beams 29 latched to both at regular intervals. The beams 29 also provide between-floor voids which can house services.

Figure 14:
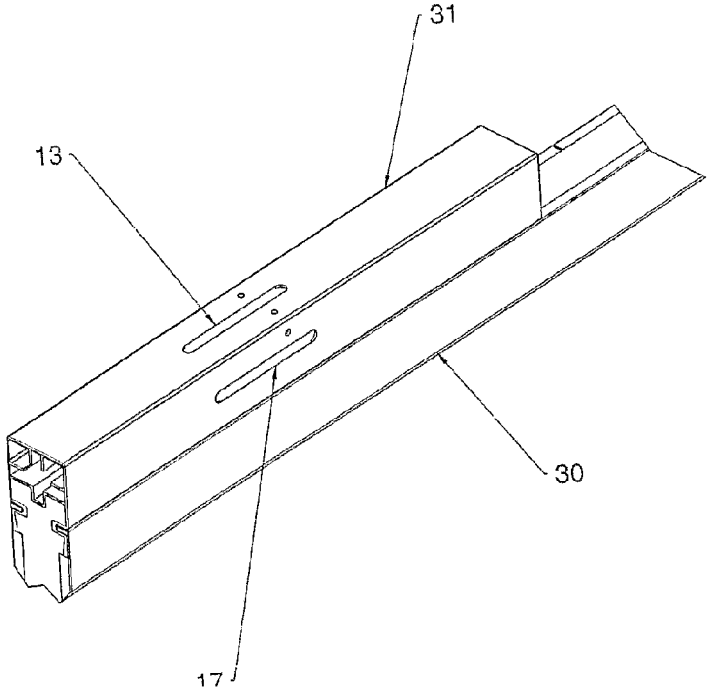
FIG. 14 is a perspective view of a modified outwardly stepped portion of the building panel.
Figure 15:
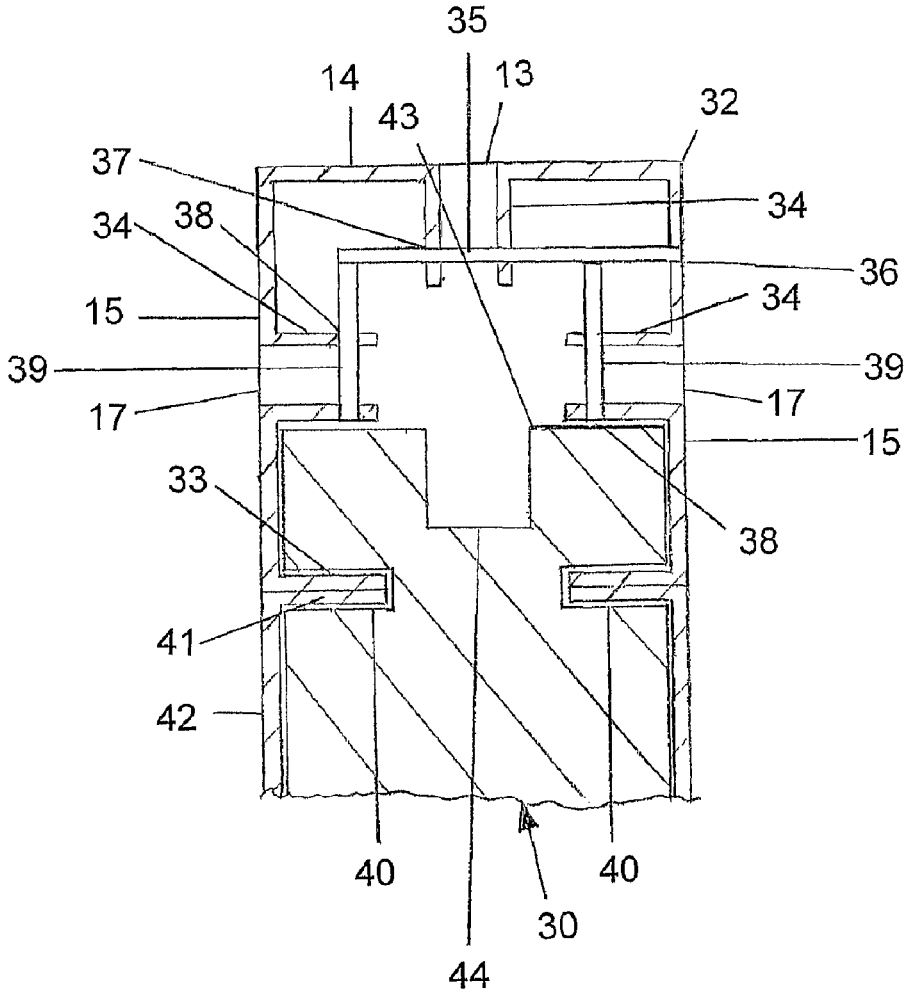
FIG. 15 is a sectional view taken along lines 15-15 shown on FIG. 14.

A building panel 30 having a modified outwardly stepped portion 31 or lug is illustrated in FIGS. 14 and 15. The outwardly stepped portion 31 uses an extruded section and is hollow. It has an inverse U shape 32 in cross-section with a pair of bottom flanges 33 extending towards each other from the base of the inverse U. Each slot 13,17 is formed from a pair of walls 34 extending inwardly from the surface 14,15 of the outwardly stepped portion 31 containing the slot 13,17. The slot 13 for the edge surface 14 has a pin 35 which extends from a hole 36 in one side portion surface 15 of the outwardly stepped portion 31 and through aligned holes 37 in the walls 34. The walls 34 of the other two slots 17 also have a pair of aligned holes 38 through each of which there extends a pin 39.

The building panel 30 has a pair of channels 40, each on opposite sides to each other for receiving the bottom flanges 33 of the outwardly stepped portion 31. Each channel 40 also receives the top flange 41 of a sheet 42 which covers a major side surface of the building panel 30. The building panel 30 protrudes above the channel 40 for a length coincident with the length of the outwardly stepped portion 31. The edge surface 43 of the protrusion has a centrally aligned recessed channel 44 along the length of the protrusion.

Figure 16:
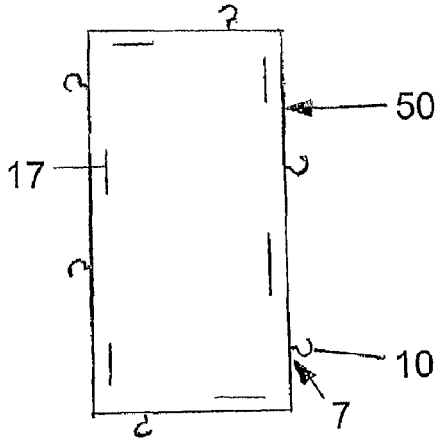
FIG. 16 is a plan view of a building panel constructed in accordance with another embodiment of the invention.

A building panel 50 without stepped portions is illustrated in FIG. 16.

Figure 17:
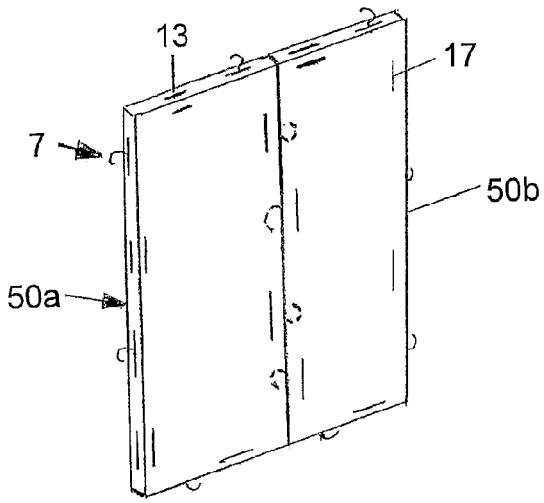
FIG. 17 is a perspective view of two building panels illustrated in FIG. 16 being interengaged so as to be parallel, coplanar and adjoining.
Figure 18:
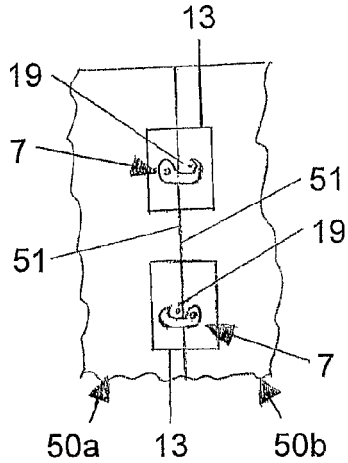
FIG. 18 is a longitudinal section through the panels of FIG. 17.

Referring to FIGS. 17 and 18, a first building panel 50*a* is shown having a second building panel 50*b* attached so as to be coplanar and adjoining. Along the adjoining major edge surfaces 51 of the two interengaged panels 50*a*,50*b*, the hooks 10 of the over-centre camlock mechanisms 7 of the first panel 50*a* are arranged to engage the pins 19 in the slots 13 in the second building panel 50*b* and the hooks 10 of the over-centre camlock mechanisms 7 of the second panel 50*b* are arranged to engage the pins 19 in the slots 13 in the first building panel 50*a*.

Figure 19:
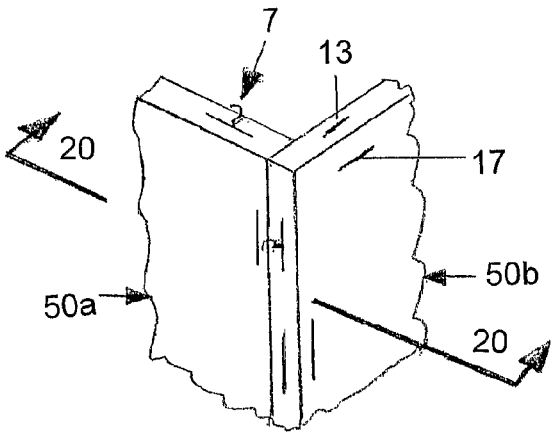
FIG. 19 is a perspective view of a portion of the two building panels shown in FIG. 17 interengaged so as to be perpendicular with one another.
Figure 20:
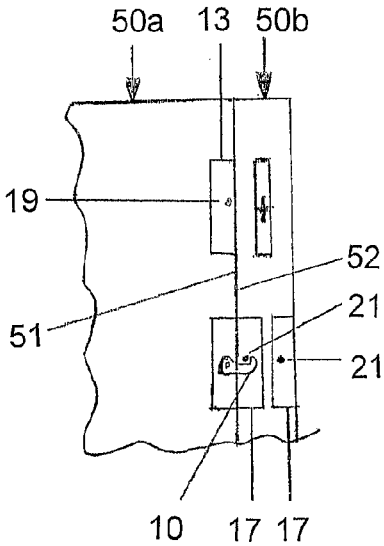
FIG. 20 is a sectional view taken along lines 20-20 shown on FIG. 19.

Referring to FIGS. 19 and 20, the first and second building panels 50*a*,50*b* are attached so as to be perpendicular to one another. A major edge surface 51 of the first panel 50*a* adjoins a major side surface 52 of the second panel 50*b* so that the hooks 10 of the over-centre camlock mechanisms 7 of the first panel major edge surface 51 are arranged to engage the pins 21 in the slots 17 in the adjoining second building panel major side surface 52.

In FIGS. 17 to 20, the unused over-centre camlock mechanisms 7 are shown as being extended for clarity but they would normally be retracted.

Whilst particular embodiments have been described, it will be understood that various modifications may be made without departing from the scope of the invention. A panel may have just over-centre camlock mechanisms along one major edge surface and the slots along an opposite edge surface and the portion of the major side surface adjacent the major edge surface. The panels are shown as being rectangular but they also may be substantially square or triangular in plan or may be any other appropriate geometric shape.

The invention claimed is:

1. A building panel (1) having a major plane and being configured to interengage with at least one other adjacent like panel, the panel (1) having:

two major side surfaces (16) which are at least substantially parallel to the major plane, and at least three major edge surfaces (2,3) substantially forming a perimeter (4) of the panel (1), at least one said major edge surface (2,3) including an alternation of at least one inwardly stepped portion (5) and at least one outwardly stepped portion (6) along it;

each said inwardly stepped portion (5) having a major edge surface forming a first surface segment (5) of a said major edge surface (2,3);

each outwardly stepped portion (6) having a major edge surface forming a second surface segment (14) of a said major edge surface (2,3), and two major side surfaces each forming a side surface segment (15) of a respective major side surface (16) of the panel (1);

at least one said inwardly stepped portion comprising an engaging means first portion (7) at said first surface segment (5); and at least one said outwardly stepped portion (6) comprising an engaging means second portion comprising three parts (17,17,13) situated respectively at the two side surface segments (15) and at said second surface segment (14), each said part being adjacent to at least one other said part whereby each inwardly stepped portion (5) is dimensioned to receive an outwardly stepped portion on a major edge surface of an adjacent like panel and the engaging means first portion (7) is latchingly engagable with any one of the engaging means second portion parts (13,17) of said adjacent like panel enabling the major planes of the two panels, when interengaged, to be selectively substantially parallel and coincident or substantially perpendicular.

2. The building panel as claimed in claim 1, wherein each said part (13,17) of the engaging means second portion comprises at least one recess in said second surface segment (14) or said side surface segment (15).

3. The building panel as claimed in claim 2, wherein the engaging means second portion has a pin (19,21) in each said recess (13,17).

4. The building panel as claimed in claim 1, wherein the engaging means first portion (7) is arranged to extend from said first surface segment (5).

5. The building panel as claimed in claim 4, wherein the engaging means first portion (7) is retractably extendable from said first surface segment (5).

6. The building panel as claimed in claim 3, wherein the engaging means first portion (7) comprises an over-centre camlock mechanism for latchingly engaging the pin (19,21).

7. The building panel as claimed in claim 1, wherein the building panel (1) has at least two degree rotational symmetry when rotated about a central axis (60) extending perpendicularly to said major plane.

8. The building panel as claimed in claim 1, wherein one major side surface (16) of the building panel (1) has access means (11) for providing access for a tool to operate the engaging means first portion (7).

9. The building panel as claimed in claim 1, wherein both major side surfaces (16) of the building panel (1) have access means for providing access for a tool to operate the engaging means first portion (7).

10. A structure (24) comprising a plurality of said building panels (1) as claimed in claim 1 and assembled in an interengaging manner.

11. A structure including at least one said building panel (1*a*) as claimed in claim 1, and at least one panel (27) comprising at least part of a column or beam, said column or beam panel (27) having engaging means for latchingly engaging at least one of said engaging means second portion parts (17) or said engaging means first portion of said building panel (1*a*).

12. The structure as claimed in claim 10, comprising three said building panels (1*a*,1*b*,22*a*), the first panel (1*a*) of said three panels having said engaging means second portion, the second panel (1*b*) of said three panels having said engaging means first portion (7) engaging one said part (13) of the engaging means second portion of said first panel (1*a*), and the third panel (22*a*) of said three panels having said engaging means first portion (7) engaging another one of said parts (17) of the engaging means second portion of said first panel (1*a*), wherein the major planes of said three panels form a "T".

13. The structure as claimed in claim 12, including a fourth said building panel (22*b*), said fourth panel (22*b*) engaging another one of said parts (17) of the engaging means second portion of said first panel (1*a*), wherein the major planes of said four panels form a cross.

14. The structure as claimed in claim 10 and including the access means (11) as claimed in claim 10, wherein the access means (11) for providing access for the tool to operate the engaging means first portion (7) is accessible from only inside the structure.

* * * * *